US006834924B2

(12) United States Patent
Hollenstein

(10) Patent No.: US 6,834,924 B2
(45) Date of Patent: Dec. 28, 2004

(54) DRAWER INSERT

(75) Inventor: Helmut Hollenstein, Lustenau (AT)

(73) Assignee: Julius Blum Gesellschaft m.b.H., Höchst (AT)

( * ) Notice: Subject to any disclaimer, the term of this patent is extended or adjusted under 35 U.S.C. 154(b) by 0 days.

(21) Appl. No.: 10/144,742

(22) Filed: May 15, 2002

(65) Prior Publication Data

US 2002/0171344 A1 Nov. 21, 2002

(30) Foreign Application Priority Data

May 17, 2001 (AT) ..... GM 397/2001
Nov. 2, 2001 (AT) ..... GM 849/2001

(51) Int. Cl.[7] ..... A47B 88/20

(52) U.S. Cl. ..... 312/348.3; 312/348.1; 312/348.2; 206/557

(58) Field of Search ..... 312/348.1, 348.2, 312/348.3, 348.4, 291, 302; 296/557, 558, 561; 220/4.25, 4.24, 500, 529, 530

(56) References Cited

U.S. PATENT DOCUMENTS

| | | | | | |
|---|---|---|---|---|---|
| 182,726 | A | * | 9/1876 | Whitman | 312/190 |
| 2,148,681 | A | | 2/1939 | Cameron | 220/22 |
| 2,369,728 | A | * | 2/1945 | Farkas | 294/168 |
| 4,109,826 | A | * | 8/1978 | Maisonneuve | 221/72 |
| 4,651,544 | A | * | 3/1987 | Hungerford | 70/63 |
| 5,016,772 | A | * | 5/1991 | Wilk | 220/8 |
| 5,385,230 | A | * | 1/1995 | Nygard et al. | 206/214 |
| 5,738,425 | A | * | 4/1998 | Rosenberg et al. | 312/348.2 |
| 5,883,806 | A | * | 3/1999 | Meador et al. | 364/479.14 |
| 5,901,848 | A | * | 5/1999 | Gorlich et al. | 206/439 |
| 6,073,794 | A | * | 6/2000 | Bidot | 220/529 |
| 6,129,433 | A | * | 10/2000 | Rosenberg et al. | 312/348.2 |
| 6,467,622 | B1 | * | 10/2002 | Hull | 206/553 |

FOREIGN PATENT DOCUMENTS

| | | |
|---|---|---|
| AT | 003039 U1 | 9/1999 |
| AT | 003784 U1 | 8/2000 |
| AT | 004052 U1 | 1/2001 |
| CH | 174593 | 4/1935 |
| DE | 29511834 U1 | 9/1995 |
| EP | 0362806 A2 | 4/1990 |
| GB | 488435 | 7/1938 |
| WO | 98/06300 | 2/1998 |

* cited by examiner

*Primary Examiner*—Leslie A. Braun
*Assistant Examiner*—Steven Marsh
(74) *Attorney, Agent, or Firm*—Wenderoth, Lind & Ponack, L.L.P.

(57) ABSTRACT

A drawer insert, in particular a cutlery insert, which may be adapted to different drawer sizes. The drawer insert comprises a plurality of separate trays (6, 7) each delimiting a receiving space. At least one of the trays (7) is compressible in a resilient manner. The trays (6, 7) are surrounded by a frame (8) whereof lateral delimiting struts (9) are compressible in a resilient manner.

27 Claims, 12 Drawing Sheets

DRAWER INSERT

BACKGROUND OF THE INVENTION

The invention relates to a drawer insert, in particular a cutlery insert, which may be adapted to different drawer sizes and comprises a plurality of separate trays each delimiting a receiving space.

The receiving space serves for example to receive cutlery. A cutlery insert of this kind is known from AT 004052 U1 (Blum). Furthermore, drawers having resilient separators are known, as described in AT 003039 U1 (Blum) and U.S. Pat. No. 2,148,681 A (Cameron).

WO 98/06300 describes a cutlery insert having displaceable side compartments. This cutlery insert may be adapted to drawers of different widths. It is not possible to make any adjustment in the direction perpendicular to the front panel.

Drawers may have both lengthwise and widthwise dimensions which differ slightly. In the particular case of drawers of wood, differences may arise, for example, depending on whether the drawer is constructed such that it is closed on four sides and the front panel is placed on the external drawer wall, or whether the actual drawer is open towards the front and is only covered by the front panel.

The length of the drawer will thus differ with the way the depthwise dimension of the item of furniture is sealed.

SUMMARY OF THE INVENTION

The object of the invention is to provide an improved drawer insert which offers optimum possibilities for adapting to drawers having different dimensions.

The object is achieved in accordance with the invention in that at least one of the trays is compressible in a resilient manner.

An example embodiment of the invention provides for the at least one tray to comprise two half-shell elements between which at least one spring pressing the half-shell elements apart is arranged.

In some cases, the entire interior of the drawer is not filled by the drawer insert. So that the individual trays are held stably in the drawer, a frame is provided which surrounds the trays and holds them together. A drawer insert of this kind is known from AT 00 378 U1 (Blum).

In accordance with the invention, it is provided for the trays to be surrounded by a frame in which at least the lateral delimiting struts are compressible in resilient manner.

Advantageously, it is provided for the lateral delimiting struts to have at at least one end a telescopically displaceable head part which is pressed by springs up to a drawer wall, and for the head parts of the lateral delimiting struts to have vertical grooves into which the terminating walls of the frame may be pushed.

Very good division of a drawer is achieved with at least two frames, in which case at least one spreading element which is resilient in its longitudinal direction and presses the frames against two mutually opposing delimiting walls of the drawer, for example the drawer frames, is provided.

Various example embodiments of the invention will be described below with reference to the figures of the drawing.

DETAILED DESCRIPTION OF THE PREFERRED EMBODIMENTS

Figure 3A:
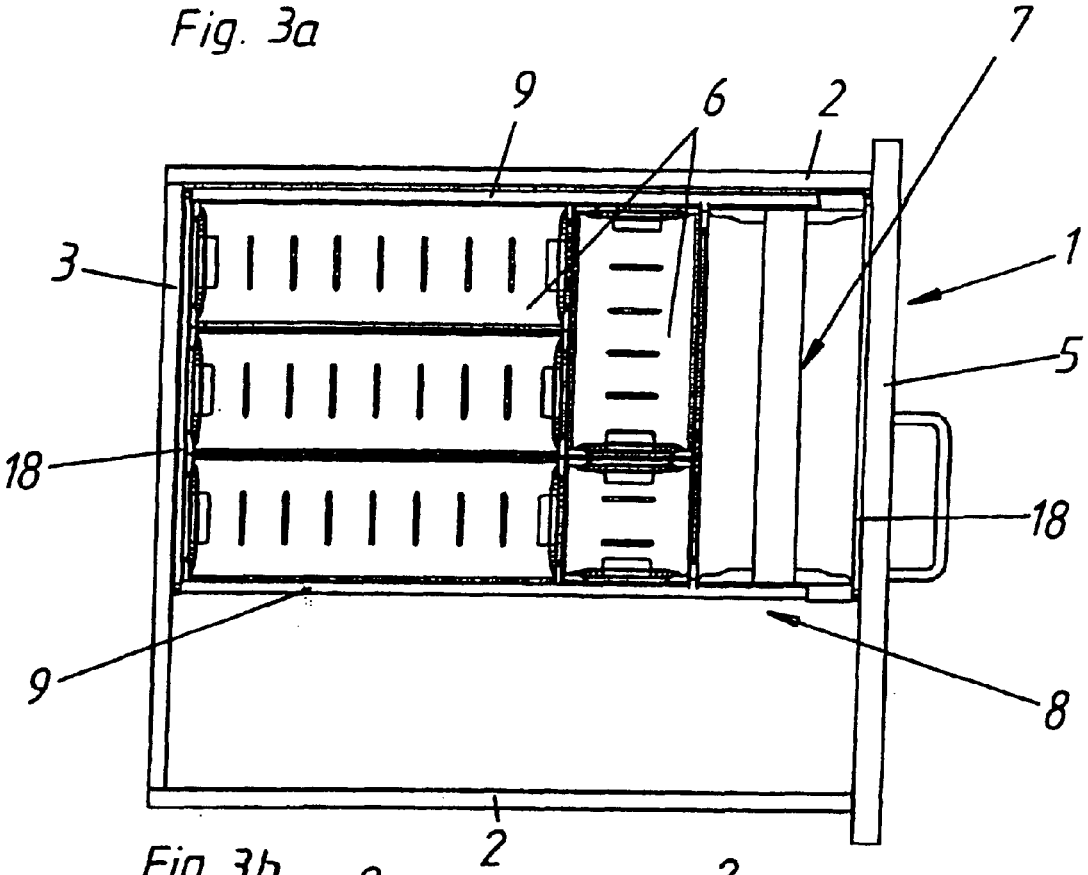
FIG. 3*a* shows a plan view of a drawer having a front panel which covers the front side of the drawer, and having an inserted drawer insert.
Figure 3B:
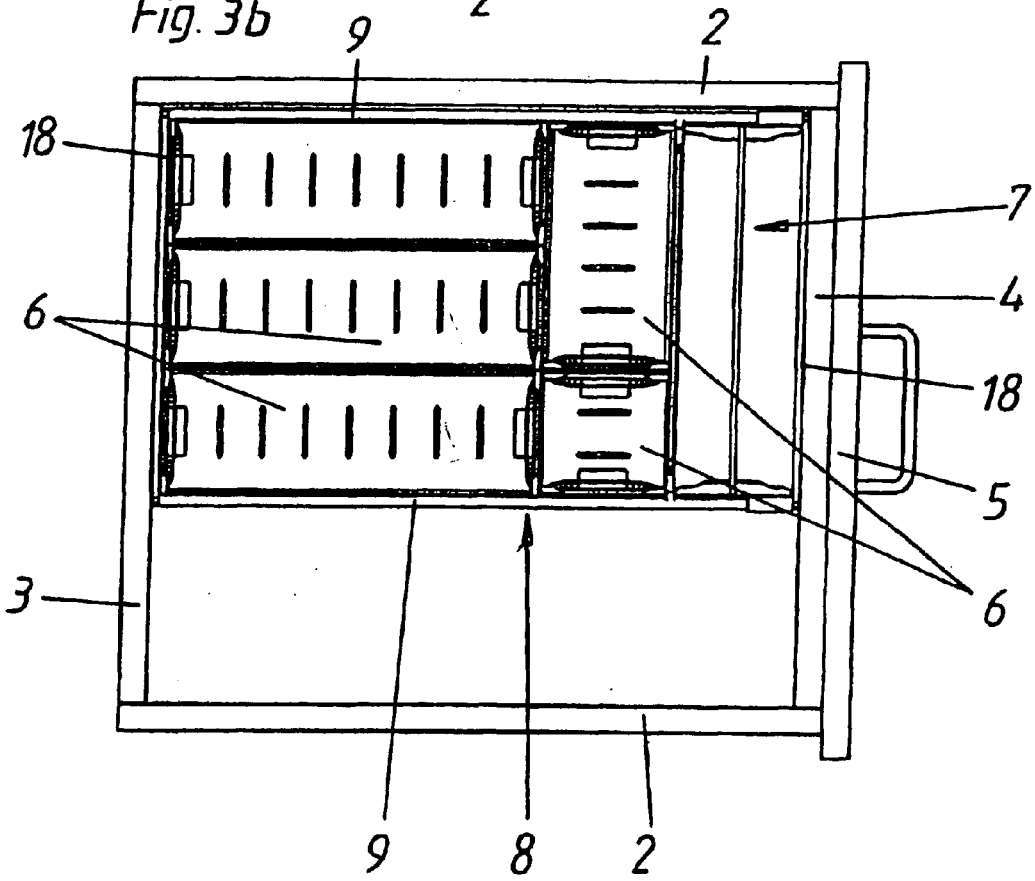
FIG. 3*b* shows a plan view of a drawer closed on four sides and having a drawer front wall and an inserted drawer insert.
Figure 4:
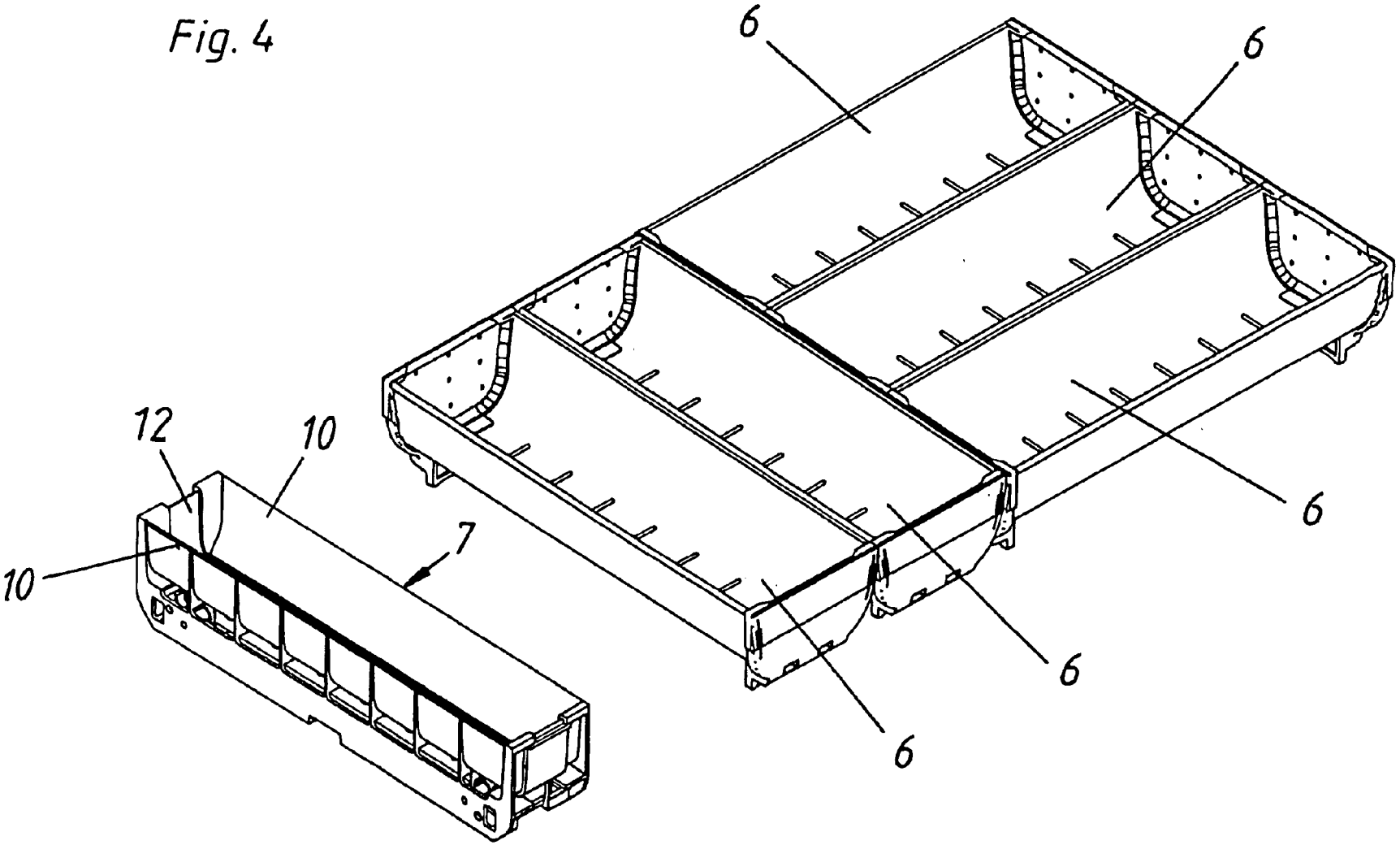
FIG. 4 shows diagrammatic illustrations of the trays.

A drawer 1 to be equipped has, in conventional manner, two drawer frames 2 and a rear wall 3. At the front the drawer 1 may either be covered only by a front panel 5, as shown in FIG. 3*a,* or it may terminate in a drawer front wall 4 inserted between the drawer frames 2, as shown in FIG. 3*b*. The drawer front wall 4 and the end faces of the drawer frames 2 are covered by the front panel 5.

Shell-shaped trays 6 which are stable, that is to say they are not deformable, and at least one tray 7 which is resilient, that is to say may be altered widthwise, are inserted into the drawer 1. The at least one tray 7, as can be seen from the drawing figures, has a bottom surface and side walls.

The trays 6 and 7 are surrounded by a frame 8 which has two lateral delimiting struts 9 which may be compressed in resilient manner. Frames 8 terminate in a rear and a front terminating wall 18. The terminating walls 18 may have different widths, so that accordingly frames 8 of different widths may be assembled. Together with the frame 8, the trays 6, 7 form the drawer insert or a part of the drawer insert.

Figure 5:
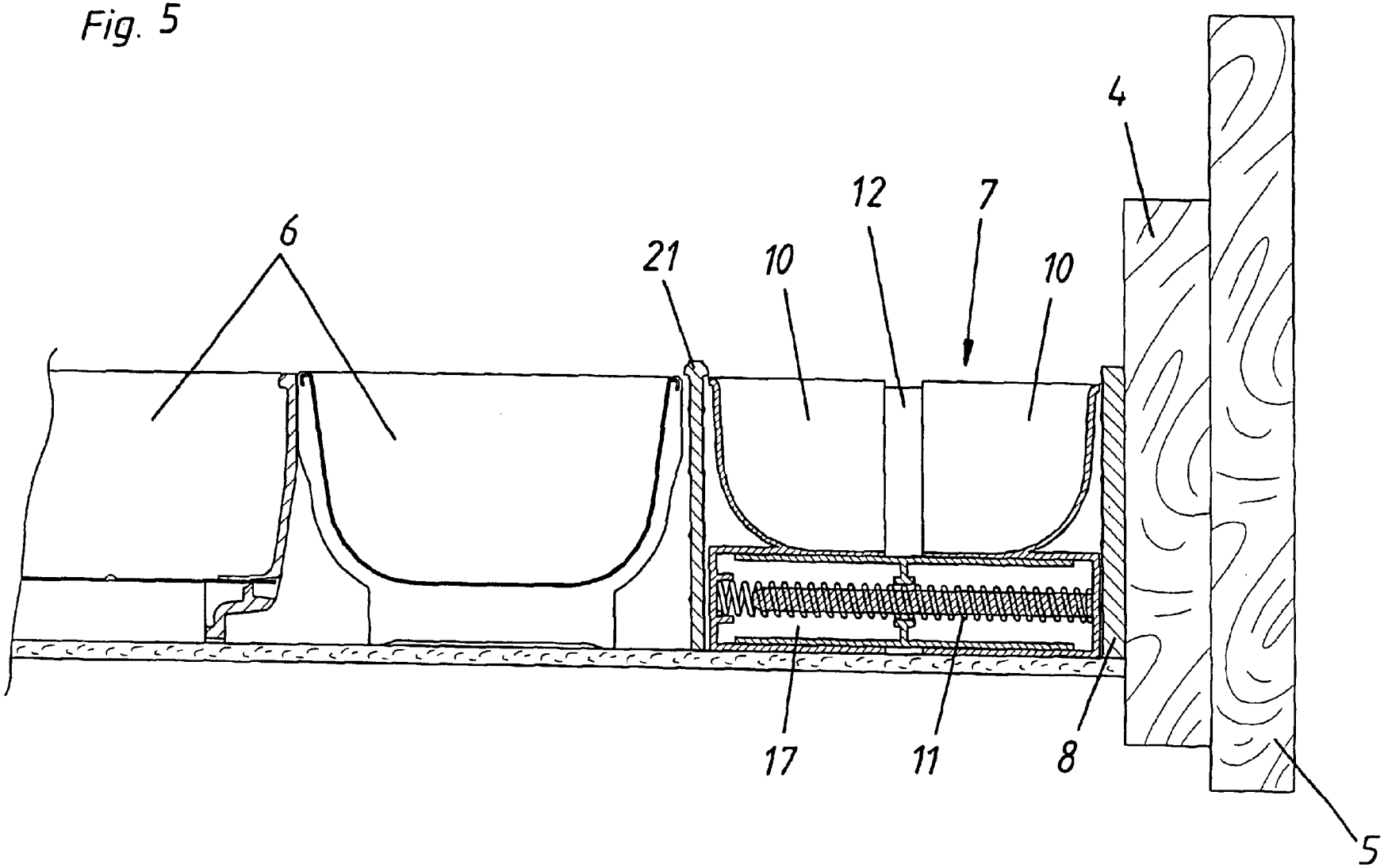
FIG. 5 shows a section through the trays, taken perpendicular to the front panel.
Figure 6:
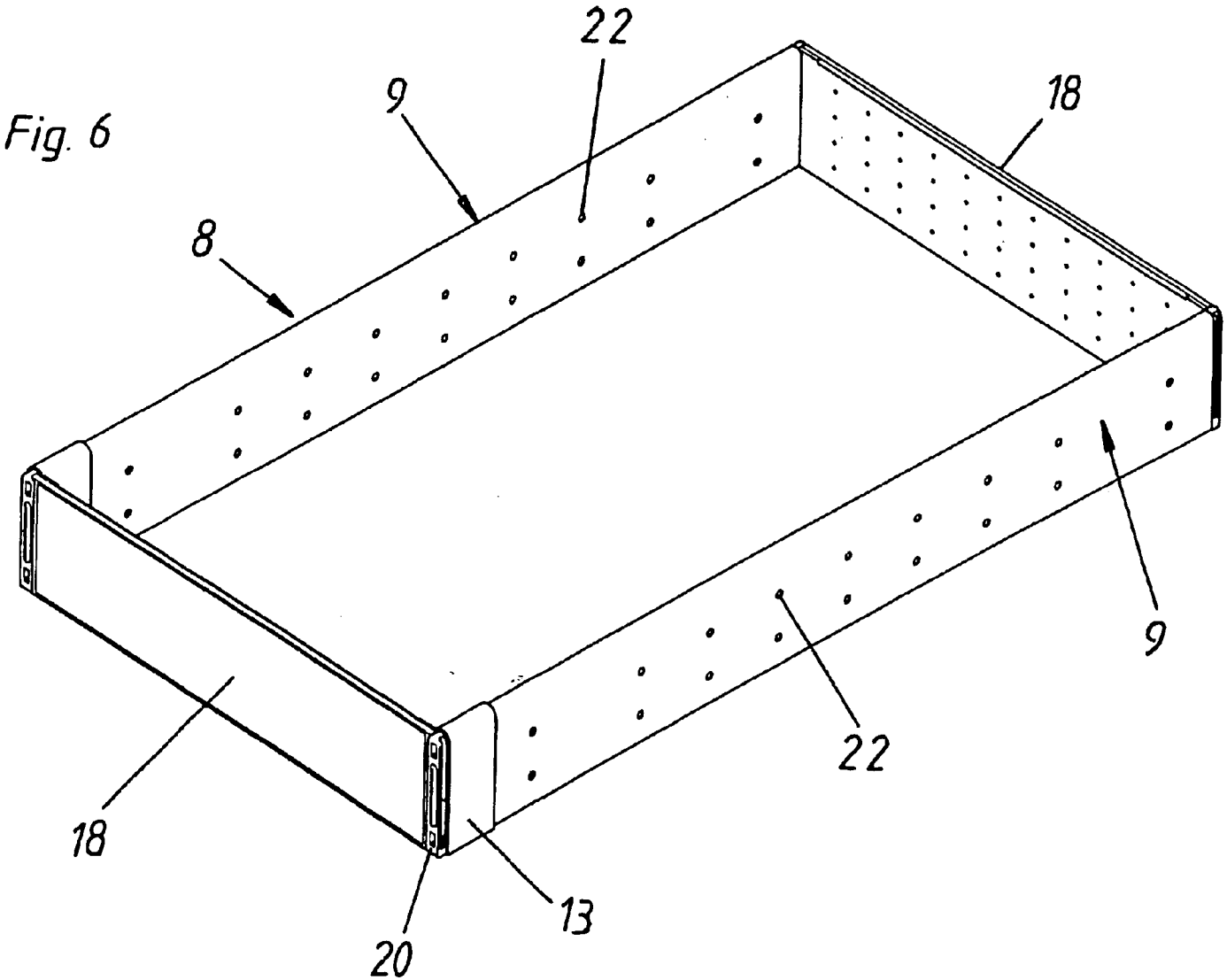
FIG. 6 shows an illustration of a frame.
Figure 7:
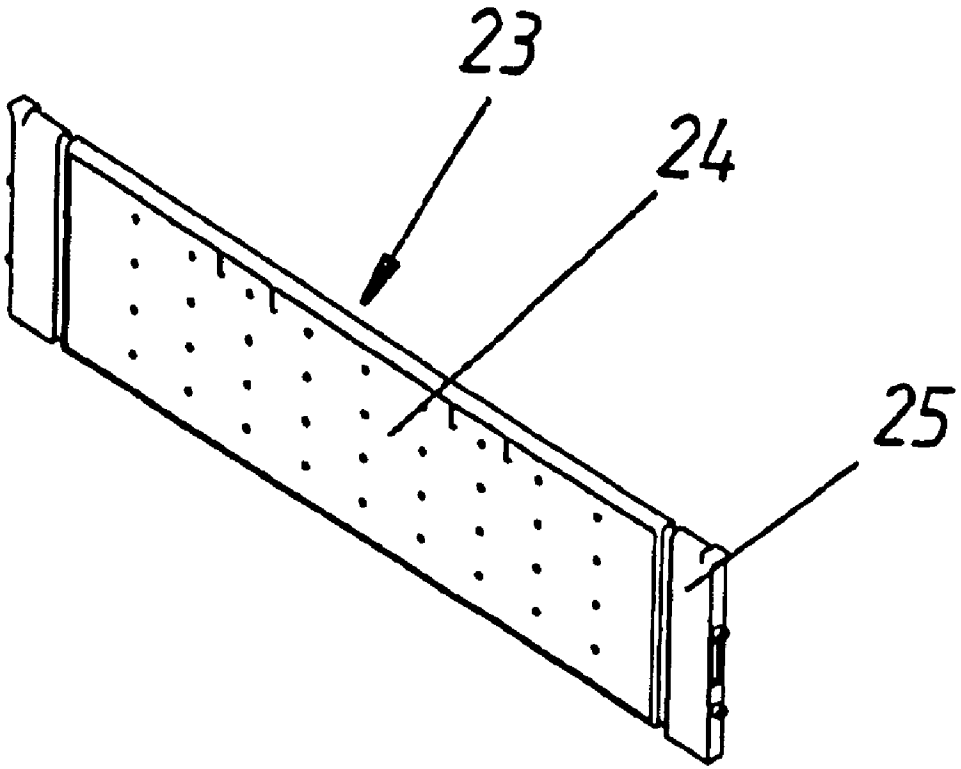
FIG. 7 shows an illustration of a partition wall.
Figure 8:
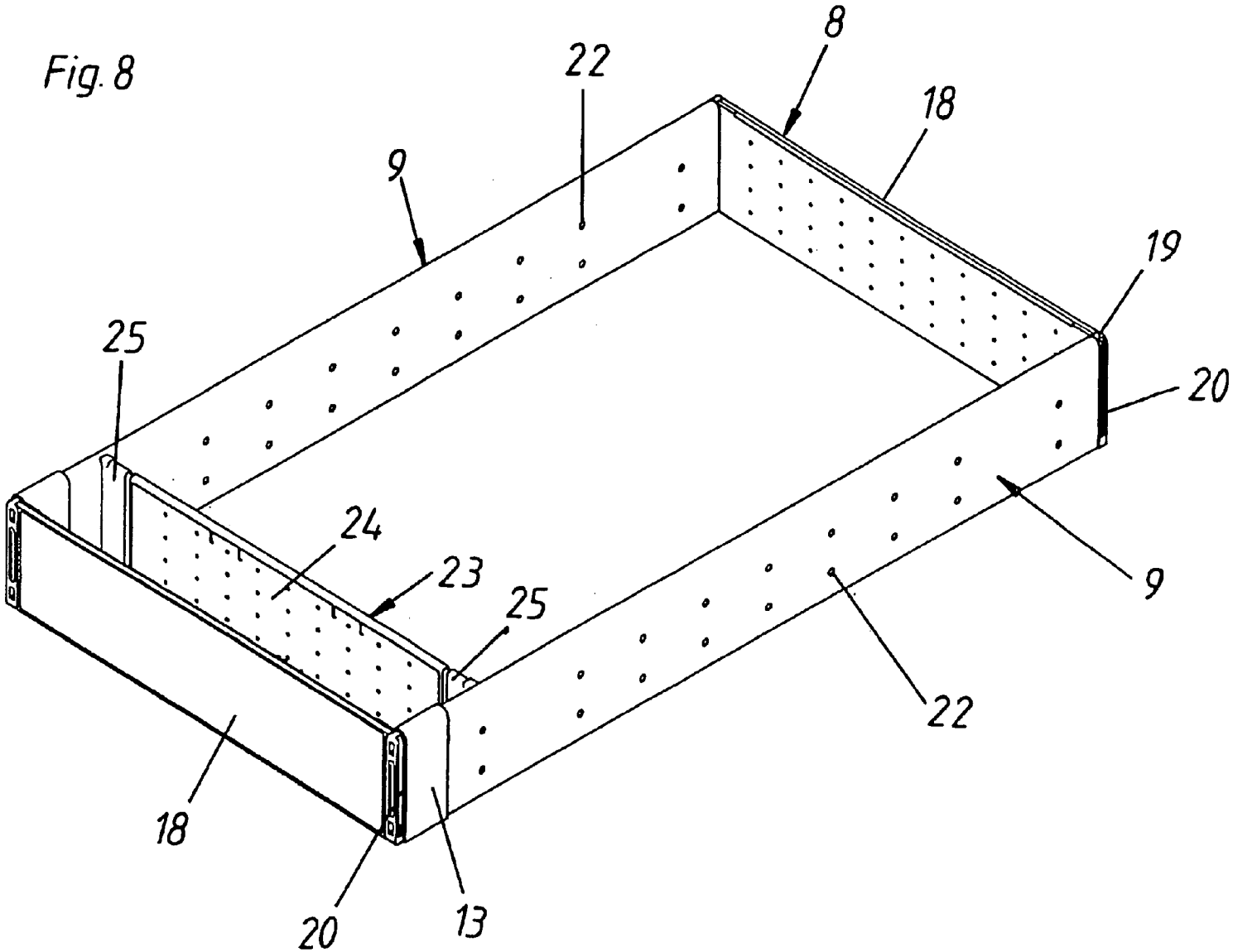
FIG. 8 shows a diagram of a frame with the partition wall inserted.
Figure 9:
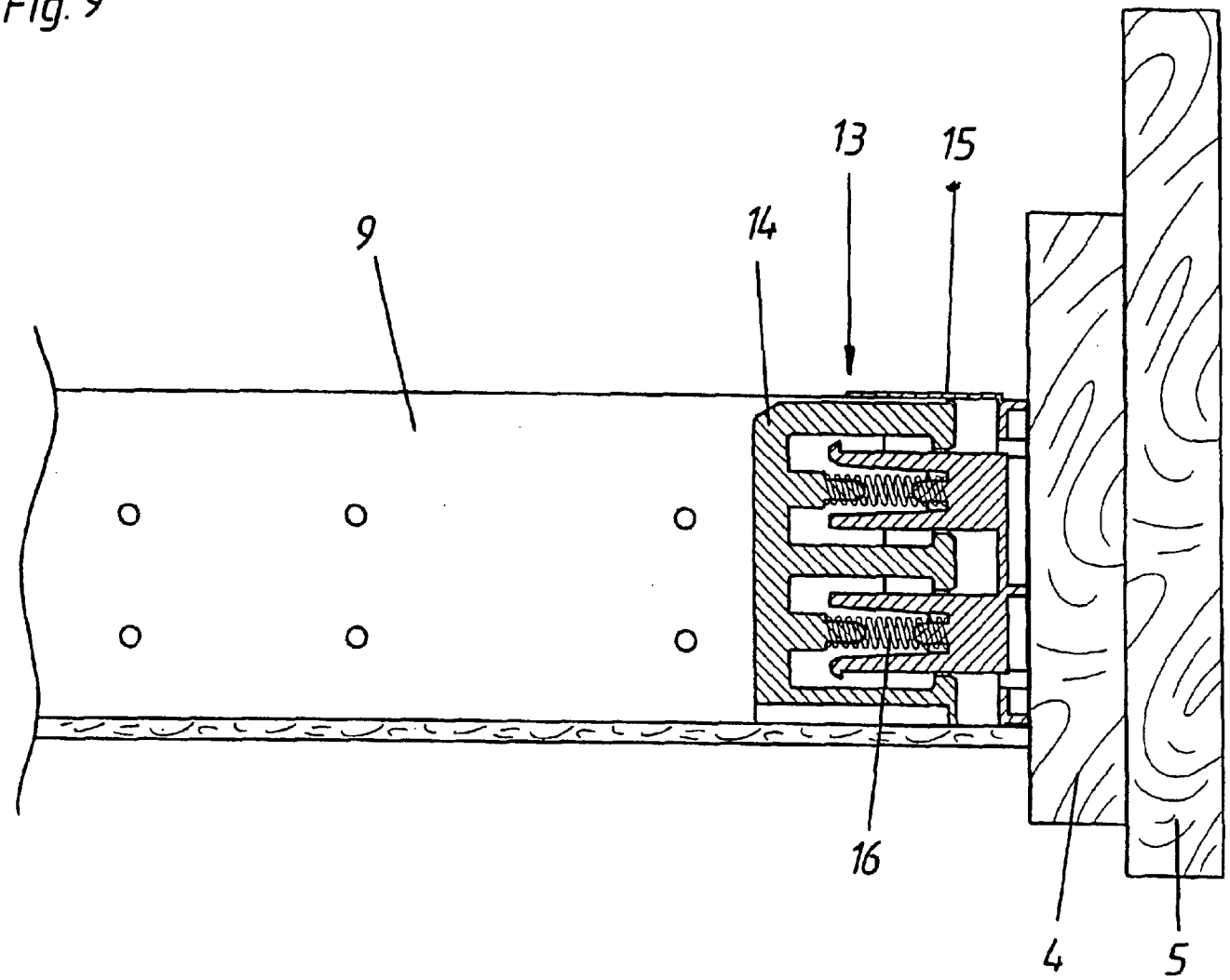
FIG. 9 shows a longitudinal section through the front end of a lateral delimiting strut.
Figure 10:
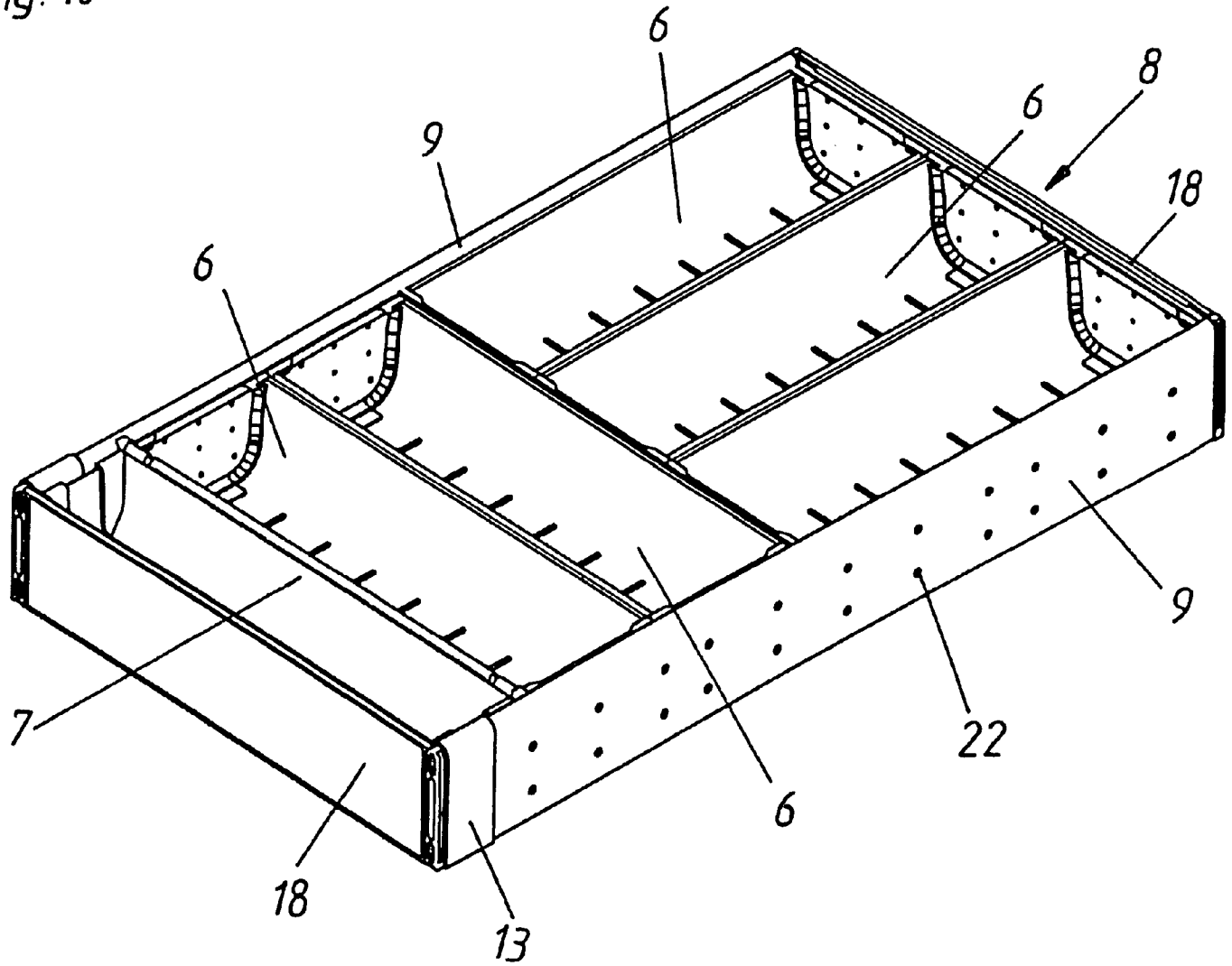
FIG. 10 shows an illustration of a frame having trays inserted.
Figure 11:
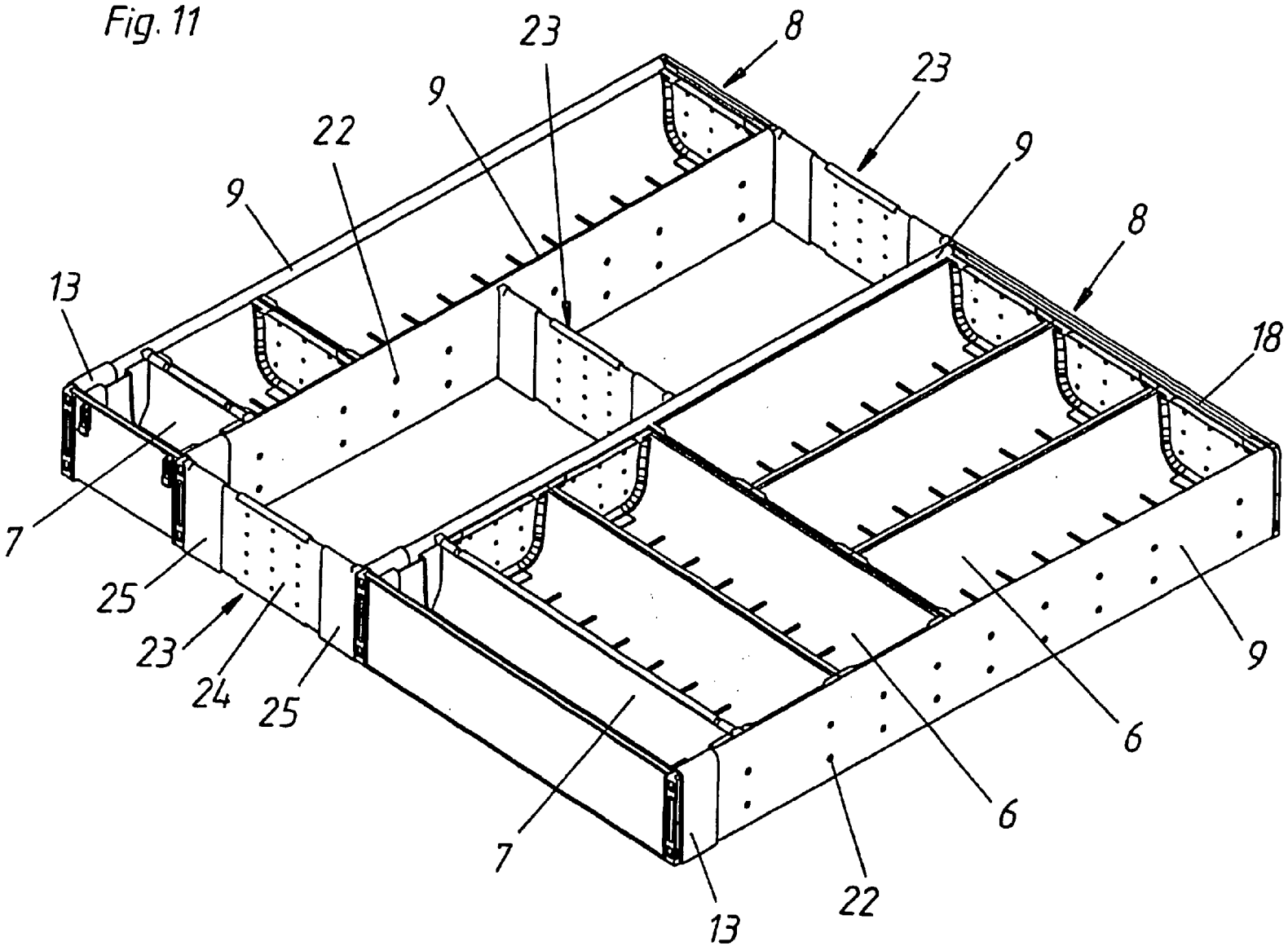
FIG. 11 shows an illustration of an assembled drawer insert.
Figure 12:
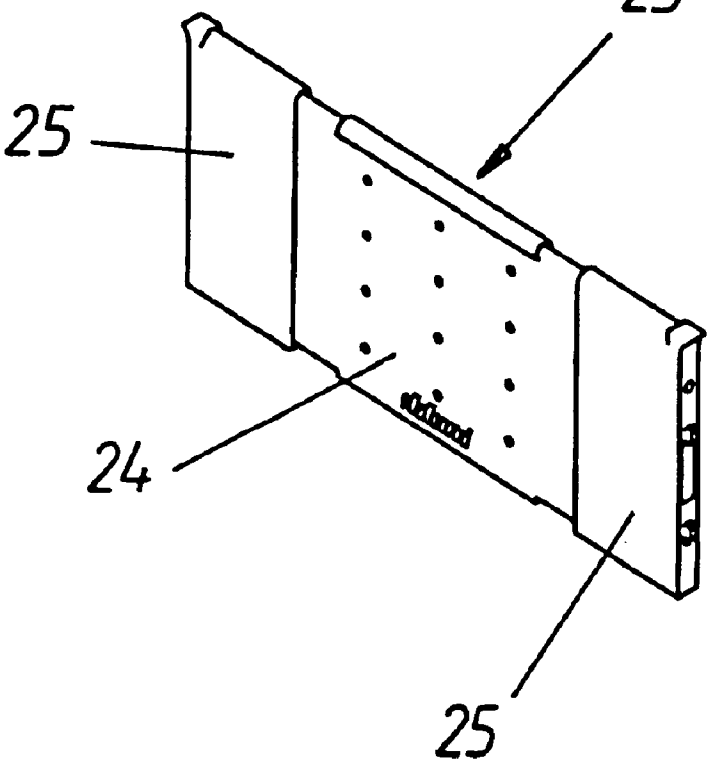
FIG. 12 shows an illustration of a partition wall.

The resilient tray 7 has two half-shell elements 10 which are pushed apart by springs 11. The half-shell elements 10 are pushed onto guide walls 12. The resilient trays 7 may thus be inserted into intermediate spaces of unequal width, for example both into the intermediate space between the rigid trays 6 and the front panel 5 of a drawer in accordance with FIG. 3*a* and into the intermediate space between the rigid trays 6 and the drawer front wall 4 in a drawer in accordance with FIG. 3*b*. In the latter case, the two half-shell elements 10 of the resilient trays 7 are compressed to a greater extent. The two half-shell elements 10, for example as seen from FIG. 5, can each form a side wall and part of the bottom wall.

The springs 11 are located in a chamber 17 underneath the cutlery receiving space in the tray 7.

In the embodiment shown, a partition wall 23 is provided between the rigid trays 6 and the tray 7 compressible in resilient manner. The partition wall 23 prevents the trays 6 from being pressed upwards by the tray 7. Partition walls 23 of different lengths adapted to different frame widths are used.

The lateral delimiting struts 9, which are preferably made from metal, have terminating pieces 19 of synthetic material at the rear end. The terminating pieces 19 are provided on both sides with a respective vertical dovetail groove 20 into which the terminating walls 18 may be pushed by means of corresponding connecting pieces such as webs or pegs.

So that the lateral delimiting struts 9 of the frame 8 can also be adapted to the different internal dimensions of the drawer 1, they are provided at one end with a telescopically compressible head part 13 which comprises a part 14 firmly anchored in the lateral delimiting strut 9 and a pressed part 15 which may be placed thereon. Between the parts 14 and 15 there are arranged pressure springs 16 which, in the example embodiment shown, press the part 15 against the front wall 4 or front panel 5.

The head parts 13 also have on both sides a respective groove 20 of dovetail cross-section, with the result that the terminating walls 18 may be coupled front and rear to the lateral delimiting struts 9.

Furthermore, the lateral delimiting struts 9 are provided with holes 22 in which partition walls 23 may be anchored. The partition walls 23 are in the form of spreading elements which have a central part 24 and two lateral anchoring parts 25 between which spring elements are arranged. The partition walls 23 are thus compressible and may easily be inserted into the frame. The anchoring parts 25 each have two pegs which project into holes 22 in the lateral delimiting struts 9. It is possible to divide a frame 8 merely by means of partition walls 23. In the example embodiment shown, a partition wall 23 is inserted in each case between the rigid trays 6 and the resiliently compressible tray 7.

Figure 1:
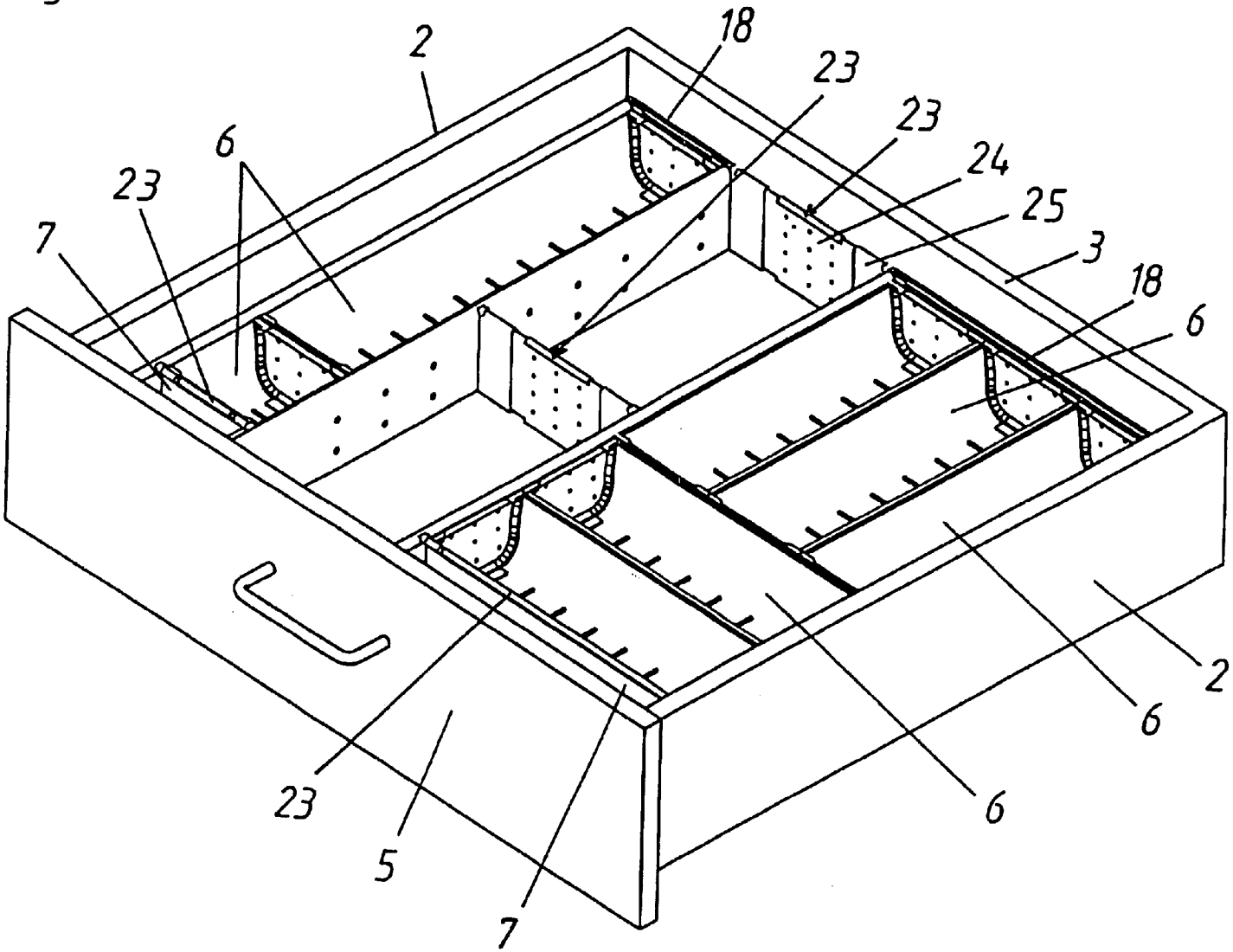
FIG. 1 shows an illustration of a drawer having a drawer insert according to the invention.
Figure 2:
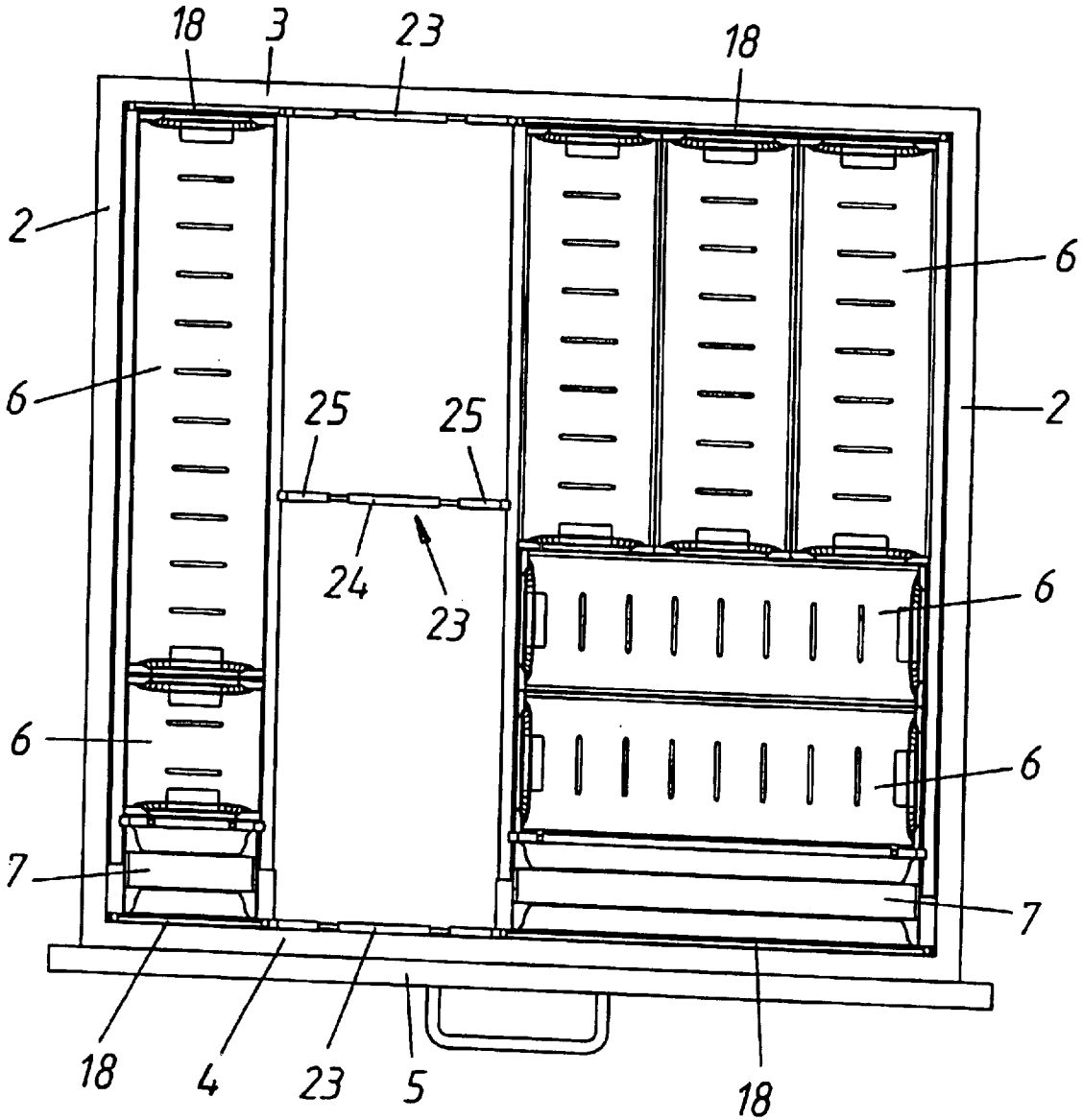
FIG. 2 shows a plan view of a drawer having the drawer insert according to the invention.

In the example embodiment according to FIGS. 1 and 2, two frames 8 which are of different widths and in which in each case a different number of fixed trays 6 and resiliently compressible trays 7 of a different length are located are inserted into the drawer.

Between the frames 8, there are once again partition walls 23 in the form of spreading elements, which press the frames 8 in each case against the drawer frames 2 of the drawer.

As has been mentioned, the partition walls 23 have different lengths, depending on whether they are inserted into a narrow frame as shown on the left in FIG. 2, a wide frame 8 as shown on the right in FIG. 2, or between the frames 8. The partition walls 23 are preferably made from synthetic material. The lateral delimiting struts 9 are provided with holes 22 on both sides so that the partition walls 23 may be arranged both within a frame 8 and between two frames 8, and may be anchored in the lateral delimiting struts 9.

A drawer having a drawer insert as described above, having a plurality of trays assembled in a frame, can have at least one of the partition walls 23 in the form of spreading elements arranged between the frame and a delimiting wall of the drawer. The at least one resilient spreading element could be arranged between the frame and a drawer frame. The spreading elements 23 could be provided between two frames each having a plurality of trays as described above, in which case the at least one spreading element is resilient in its longitudinal direction and presses the frames against two mutually opposing delimiting walls of the drawers and arranged between the frames.

As discussed above, lateral delimiting struts 9 have a pressed part 15. As noted above, the part 15 may be pressed against the front wall 4 or front panel 5. The pressed part may also be pressed towards a drawer rear wall.

What is claimed is:

1. A drawer insert which may be adapted to different drawer sizes, comprising a plurality of separate trays each delimiting a receiving space, wherein at least one of said trays is structured and arranged so as to be capable of having said receiving space adjusted by resilient compression of said at least one of said trays such that said insert can be adapted to different drawer sizes, wherein said at least one of said trays comprises two tray elements between which at least one spring is arranged pressing said tray elements apart in horizontal direction and said at least one of said trays has a bottom surface and side walls.

2. The drawer insert of claim 1, wherein said at least one of said trays is resiliently compressible in one direction.

3. The drawer insert of claim 1, wherein said at least one of said trays includes relatively movable components defining the receiving space which are interconnected by a mechanism permitting resilient compression.

4. The drawer insert of claim 1, wherein said at least one of said trays is compressible transversely in relation to its longitudinal direction.

5. The drawer insert of claim 1, wherein said trays are surrounded by a frame.

6. The drawer insert of claim 5, wherein lateral delimiting struts of said frame are compressible in a resilient manner.

7. A drawer insert which may be adapted to different drawer sizes, comprising a plurality of separate trays each delimiting a receiving space, wherein at least one of said trays is structured and arranged so as to be capable of having said receiving space adjusted by resilient compression of said at least one of said trays such that said insert can be adapted to different drawer sizes;

wherein said trays are surrounded by a frame;

wherein lateral delimiting struts of said frame are compressible in a resilient manner; and wherein said lateral delimiting struts have at at least one end telescopically displaceable head parts each comprising a pressed part pressed by at least one spring for being pressed toward a drawer wall.

8. The drawer insert of claim 7, wherein said pressed part is pressed by said at least one spring in a rear direction for being pressed towards a drawer rear wall.

9. The drawer insert of claim 7, wherein said pressed part is pressed by said at least one spring in a forward direction for being pressed towards a front delimiting wall of a drawer.

10. The drawer insert of claim 7, wherein said frame includes terminating walls and said head parts of said lateral delimiting struts have vertical grooves into which terminating walls of said frame may be pushed.

11. The drawer insert of claim 10, wherein said grooves have a dovetail profile and said terminating walls have corresponding anchoring webs.

12. The drawer insert of claim 10, wherein said grooves have a dovetail profile and said terminating walls have corresponding anchoring pegs.

13. The drawer insert of claim 10, wherein said head parts of said lateral delimiting struts have a vertical groove on each side thereof.

14. The drawer insert of claim 1, wherein a partition wall is arranged between said at least one of said trays capable of having said receiving space adjusted by resilient compression and rigid trays of said plurality of separate trays.

15. The drawer insert of claim 14, wherein said partition wall is compressible in a resilient manner.

16. A drawer insert which may be adapted to different drawer sizes, comprising a plurality of separate trays each delimiting a receiving space, wherein at least one of said trays is structured and arranged so as to be capable of having said receiving space adjusted by resilient compression of said at least one of said trays such that said insert can be adapted to different drawer sizes;

wherein a partition wall is arranged between said at least one of said trays capable of having said receiving space adjusted by resilient compression and rigid trays of said plurality of separate trays;

wherein said partition wall is compressible in a resilient manner; and wherein said partition wall comprises a central part and two anchoring parts and wherein springs are provided between said central part and said anchoring parts which press said central part and said anchoring parts apart.

17. The drawer insert of claim 16, wherein:

said trays are surrounded by a frame having lateral delimiting struts; and said anchoring parts have pegs projecting into holes in said lateral delimiting struts of said frame.

18. A drawer having a drawer insert according to claim 1, wherein said plurality of separate trays are assembled in a frame and at least one resilient spreading element is arranged between said frame and a delimiting wall of the drawer.

19. The drawer of claim 18, wherein said at least one resilient spreading element is arranged between said frame and a drawer frame.

20. The drawer of claim 19, wherein said at least one resilient spreading element is in the form of a partition wall.

21. The drawer of claim 18, wherein:

said at least one resilient spreading element comprises anchors; and said frame comprises lateral delimiting struts having holes for receiving said anchors.

22. A drawer having at least two drawer inserts each of which may be adapted to different drawer sizes and each of which comprises a plurality of separate trays each delimiting a receiving space, wherein at least one of said trays is structured and arranged so as to be capable of having said receiving space adjusted by resilient compression of said at least one of said trays such that said insert can be adapted to different drawer sizes, wherein said plurality of separate trays of each of said at least two drawer inserts are assembled in at least two frames and at least one resilient spreading element which is resilient in a longitudinal direction thereof and presses said at least two frames against two mutually opposing delimiting walls of the drawer is arranged between said at least two frames.

23. The drawer of claim 22, wherein said at least one resilient spreading element is in the form of a partition wall.

24. A drawer insert which may be adapted to different drawer sizes and comprises plurality of separate trays each delimiting a receiving space, characterized in that at least one of said trays is compressible in a resilient manner and in that said at least one of said trays comprises two half-shell elements between which at least one spring pressing said half-shell elements apart is arranged, wherein said at least one of said trays has a bottom surface and side walls.

25. The drawer insert of claim 24, wherein said at least one spring is arranged underneath the receiving space of said at least one of said trays.

26. The drawer insert of claim 24, wherein guide walls are provided for said half-shell elements.

27. A drawer according to claim 1, wherein said tray elements are in the form of half-shells.

* * * * *